US006763764B2

(12) United States Patent
Avetisian et al.

(10) Patent No.: US 6,763,764 B2
(45) Date of Patent: Jul. 20, 2004

(54) MULTI-UNIT PYROTECHNIC INITIATION SYSTEM

(75) Inventors: Vahan Avetisian, Newbury Park, CA (US); Eishi Kajita, Westlake Village, CA (US); Mher Chimayan, Burbank, CA (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 10/400,768

(22) Filed: Mar. 27, 2003

(65) Prior Publication Data

US 2003/0154876 A1 Aug. 21, 2003

Related U.S. Application Data

(63) Continuation of application No. 09/702,620, filed on Oct. 31, 2000, now abandoned.

(51) Int. Cl.[7] ..... F42B 3/12
(52) U.S. Cl. ..... 102/202.19
(58) Field of Search ..... 102/202.14, 202.9, 102/200; 89/39, 35.01; 280/730

(56) References Cited

U.S. PATENT DOCUMENTS 3,776,138 A * 12/1973 Moses ..... 102/248
3,868,126 A * 2/1975 Radke et al. ..... 280/735
3,983,624 A * 10/1976 Gross ..... 29/854
4,036,103 A * 7/1977 Gawlick et al. ..... 89/35.01
4,213,635 A * 7/1980 Inokuchi et al. ..... 280/737
4,920,885 A * 5/1990 Bowman et al. ..... 102/281
5,016,914 A * 5/1991 Faigle et al. ..... 280/741
5,131,679 A * 7/1992 Novak et al. ..... 280/736
5,460,405 A * 10/1995 Faigle et al. ..... 280/735
5,558,366 A * 9/1996 Fogle et al. ..... 280/736
5,566,976 A * 10/1996 Cuevas ..... 280/737
5,602,359 A * 2/1997 Hambro et al. ..... 102/202.5
5,690,357 A * 11/1997 Cuevas ..... 280/737
5,798,476 A * 8/1998 Bailey ..... 102/202.7
5,880,534 A * 3/1999 Mossi et al. ..... 307/10.1
5,942,717 A * 8/1999 Pathe et al. ..... 102/202.2
6,010,152 A * 1/2000 Swann et al. ..... 280/736
6,019,389 A * 2/2000 Burgi et al. ..... 280/736
6,073,963 A * 6/2000 Hamilton et al. ..... 280/741
6,168,200 B1 * 1/2001 Greist et al. ..... 280/736
6,206,414 B1 * 3/2001 Cook et al. ..... 280/734
6,295,935 B1 * 10/2001 Swann et al. ..... 102/530
6,341,562 B1 * 1/2002 Brisighella ..... 102/202.14
6,447,007 B1 * 9/2002 DiGiacomo et al. ..... 280/741
6,460,883 B1 * 10/2002 Nakashima et al. ..... 280/736
6,491,320 B1 12/2002 Nakashima et al. ..... 280/736
2002/0050703 A1 * 5/2002 Whang et al. ..... 280/737

* cited by examiner

*Primary Examiner*—Charles T. Jordan
*Assistant Examiner*—Jordan Lofdahl
(74) *Attorney, Agent, or Firm*—Law Offices of Thomas I. Brindisi

(57) ABSTRACT

A multi-unit pyrotechnic initiation system includes two or more pyrotechnic initiators molded in place into a base. Each initiator preferably includes a body overmolded around an igniter. The retainers of two or more pyrotechnic initiators may be formed together as part of a unitary substructure.

20 Claims, 1 Drawing Sheet

MULTI-UNIT PYROTECHNIC INITIATION SYSTEM

This application is a continuation of Ser. No. 09/702,620, filed Oct. 31, 2000 and now abandoned.

BACKGROUND OF THE INVENTION

The field of this invention generally relates to pyrotechnic initiators, and more particularly to a pyrotechnic system having a number of discrete initiators.

Pyrotechnic initiators are used in a number of different applications. One important use is the inflation of an airbag in a motor vehicle. When a pyrotechnic initiator is ignited, the gas and heat released by the initiator may activate a gas generator, rupture a sealed gas unit, or perform some other work which inflates the airbag. As a safety measure, it is known to provide a number of initiators, rather than a single one, for inflating a single airbag. Each of these initiators contains only a fraction of the pyrotechnic material that would be used with a single initiator. Based on factors such as the speed of the vehicle at the time of impact, a different number of initiators are fired to inflate the airbag. For example, where two initiators are provided, a low-speed impact would trigger the firing of one initiator. A medium-speed impact would trigger the firing of one initiator, then another a millisecond later. A high-speed impact would trigger the simultaneous firing of both initiators to inflate the airbag with maximum force. In this way, the force with which the airbag contacts a person in the motor vehicle is adjusted to better compensate for the force of the accident and minimize the potential for injury resulting from excessive airbag deployment force.

While the use of a multiple-initiator assembly is desirable, manufacturing a multiple-initiator unit is complex and expensive. Typically, one or more finished initiators are installed into a larger assembly, creating a need for multiple initiator presses into a base, multiple individual seals, and multiple crimps and welds. Because a number of parts and steps are required, the chance of incurring a manufacturing error increases, thereby resulting in a larger number of rejected parts.

In addition, an insulator can is typically placed around pyrotechnic material in an initiator. The can protects the pyrotechnic material from exposure to atmospheric humidity and contaminants, and prevents ambient charges or stray currents from inadvertently igniting the pyrotechnic material. While the can is useful, it is an additional component which must be assembled into the initiator, adding to the complexity and cost of assembly of the finished part.

SUMMARY OF THE PREFERRED EMBODIMENTS

The present invention is directed toward a multi-unit pyrotechnic initiation system.

In an aspect of a preferred embodiment, two or more pyrotechnic initiators are molded in place into a base.

In another aspect of a preferred embodiment, each initiator includes a body overmolded around an igniter, eliminating the need for an insulator can around the pyrotechnic material in the igniter.

In an alternate embodiment, the retainers of two or more pyrotechnic initiators are formed together as part of a unitary substructure.

Further aspects and advantages of the preferred embodiments will appear hereinafter.

DETAILED DESCRIPTION OF THE PREFERRED EMBODIMENTS

Figure 1:
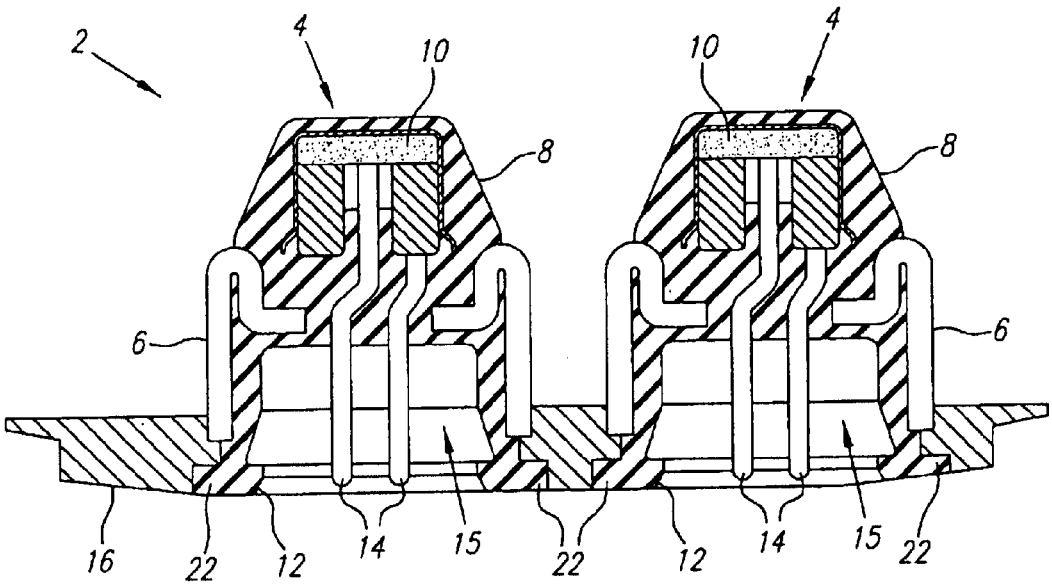
FIG. 1 is a side cross-section view of a preferred embodiment of a multi-unit pyrotechnic initiation system.

Referring to FIG. 1, a multi-unit pyrotechnic initiation system 2 is seen. The multi-unit pyrotechnic initiation system 2 includes at least two pyrotechnic initiators 4. Although FIG. 1 shows two initiators 4, more than two initiators 4 may be used. Each initiator 4 includes a retainer 6 and a nonconductive body 8. The retainer 6 protects at least a portion of the body 8, provides structural strength to the pyrotechnic initiator 4, and assists in connecting the pyrotechnic initiator 4 to its place of use. Preferably, the retainer 6 is metallic. The retainer 6 preferably takes the shape of a body of rotation, but is not limited to such a shape. The body 8 is formed around the retainer 6, preferably by an injection molding process. The body 8 is composed of a nonconductive material, preferably nylon. However, other nonconductive materials, such as plastic, that are capable of being molded or formed into a desired shape while having adequate strength and durability and adequate suitability for pyrotechnic applications may be used.

In a preferred embodiment, an igniter 10 is formed into the body 8. The igniter 10 preferably includes a pyrotechnic charge which combusts when exposed to an electric charge or other means of initiating combustion. The selection and use of a pyrotechnic charge as the igniter 10 is known to those skilled in the art. The body 8 is preferably overmolded, meaning that the body 8 is constructed to be thick enough in all three dimensions around the igniter 10 to support and protect the igniter 10, such that the retainer 6 need not extend around the outer surface of the body 8 laterally adjacent to the sides of the igniter 10. The thickness, shape and material of the body 8 also are selected such that the force generated by the firing of the igniter 10 will crack, rupture, or otherwise disrupt the body 8 such that hot gas and combustion products can escape from the body 8 and perform useful work. In a preferred embodiment, the body 8 seals the pyrotechnic charge in the igniter 10 against stray current and environmental contamination. Preferably, the igniter 10 does not utilize a separate insulator can. Instead, the overmolded body 8 performs the same sealing and protecting functions for the igniter 10 that would be performed by an insulator can. However, in an alternate embodiment, instead of overmolding the body 8 around the igniter 10, an insulator can (not shown) having a pyrotechnic charge may be attached to the body 8 and form a part of the initiator 4. The igniter 10 may be located adjacent to or inside such an insulator can, as long as the combustion of the igniter 10 is capable of igniting the pyrotechnic charge inside the insulator can. In such an alternate embodiment, the body 8 need not provide a seal for the igniter 10 or the insulator can.

The body 8 includes a connector 12 adapted to connect with a mating connector (not shown) provided at the place of use of the pyrotechnic initiator 4, such as a steering wheel or motor vehicle dashboard. The mating connector on the motor vehicle may be referred to as the socket. Preferably, two electrical leads 14 extend from the igniter 10 through the body 8 into a hollow interior 15 within the connector 12. The combination of the electrical leads 14 and the igniter 10 may be referred to as the pyrotechnic ignition assembly. The pyrotechnic initiator 4 is constructed such that the electrical leads 14 do not come in contact with the retainer 6 if the retainer 6 is conductive. If the retainer 6 is not conductive, the electrical leads 14 may contact the retainer 6 without ill effect. Because the body 8 is nonconductive, the body 8 prevents stray current from entering the electrical leads 14 through an unexpected path, thereby preventing accidental ignition of the igniter 10. In a preferred embodiment, the retainer 6 opens downward toward the connector 12. In this orientation, the retainer 6 reinforces the connector 12 and provides added durability to the connector 12. The retainer 6 may form at least a portion of the outer wall of the connector 12, or the retainer 6 may be covered over by a portion of the body 8 such that the retainer 6 is located completely within the initiator 4. However, the retainer 6 instead may be positioned to open upward, if desired.

The two or more initiators 4 in the multi-unit pyrotechnic initiation system 2 are connected by a base 16 that is preferably metallic. The shape of the base 16 depends on the shape of the location where the base 16 is to be used. For example, if the base 16 is to be used in a motor vehicle dashboard, the base 16 is shaped for attachment to a desired location in the motor vehicle dashboard. The initiators 4 are preferably formed into the base 16 by injection molding, as described below. However, the initiators 4 may be connected to the base 16 by other attachment means or strategies, if desired. Preferably, the connector 12 includes at least one flange 22 extending outward to engage the base 16 in order to further secure the initiator 4 to the base 16.

Figure 2:
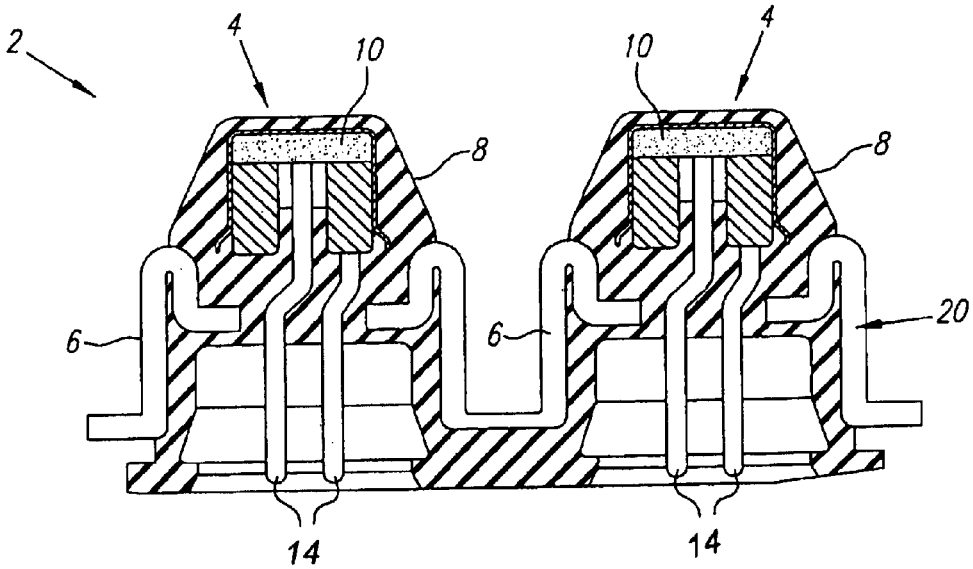
FIG. 2 is a side cross-section view of an alternate embodiment of a multi-unit pyrotechnic initiation system.

In another preferred embodiment, shown in FIG. 2, a single substructure 20 is provided, combining in a single unit all of the retainers 6 in the system 2. As above, the body 8 of each initiator 4 is molded in place around each retainer 6 in the substructure 20. The substructure 20 preferably is stamped from a single piece of sheet metal. The stamping process requires significantly less time than machining, and results in significantly less material waste than machining, because stamping forms the retainer from a thin, essentially two-dimensional sheet, while machining requires the removal of a substantial amount of material from a three-dimensional object. However, it is within the scope of this embodiment to form the substructure 20 in a way other than stamping, if desired. Where a single substructure 20 is provided, the base 16 need not be used. By providing a single substructure 20 including all of the retainers 6, durability and ease of manufacturing are enhanced. Use of the substructure 20 may be advantageous, for example, in locations where space is at a premium and the base 16 is desired to be as thin as possible. Further, the substructure 20 may be soldered or welded to a metal structure on the motor vehicle, which may be advantageous in some applications.

In a preferred embodiment, injection molding is used to assemble the system 2. In the injection molding process, a hot material in liquid form is injected into a mold having the desired shape of the finished product, and the liquid material is allowed to cool and harden into a solid form. The injection molding process is well known to those skilled in the art. In a preferred embodiment, the process begins by inserting the retainers 4 into the base 16, where they are preferably held in place via a pressure fit. The base 16 with the retainers 4 are then placed into a mold (not shown). The mold has a cavity shaped to allow liquid material to flow into spaces where it will later harden and form the body 8 of each initiator 4. Next, the igniters 10 and electrical leads 14 are placed into the mold, positioned relative to the retainers 6 such that they will be located in the proper position within each initiator 4 after each body 8 has been formed. Hot liquid is then injected into the mold, which after cooling and hardening becomes the body 8 of each initiator 4. In this way, each body 8 and each initiator 4 is molded in place onto the base 16, such that no separate seals or additional connectors are needed to secure each body 8 to the base 16. After the molding material has cooled and hardened, the base 16 structurally links the initiators 4 together to form the system 2.

In another preferred embodiment, a substructure 20 is first formed by stamping it from a metal sheet. The tools and processes used for stamping metal are known to those skilled in the art. Two or more retainers 6 are stamped into the substructure 20 as part of the stamping process. Thus, the retainers 6 are connected together as parts of the overall substructure 20. The substructure 20 is then placed into a mold (not shown). Next, the igniters 10 and electrical leads 14 are placed into the mold, positioned relative to the retainers 6 such that they will be located in the proper position within each initiator 4 after each body 8 has been formed. Hot liquid is then injected into the mold, which after cooling and hardening becomes the body 8 of each initiator 4. In this way, each body 8 and each initiator 4 is molded in place onto the base 16, such that no separate seals or additional connectors are needed to secure each body 8 to the base 16. After the molding material has cooled and hardened, the base 16 structurally links the initiators 4 together to form the system 2.

A preferred multi-unit pyrotechnic initiation system, a process for making such an initiator, and many of their attendant advantages, has thus been disclosed. It will be apparent, however, that various changes may be made in the form, construction and arrangement of the parts or in the steps of the process without departing from the spirit and scope of the invention, the form and process hereinbefore described being merely a preferred or exemplary embodiment thereof. Therefore, the invention is not to be restricted or limited except in accordance with the following claims and their legal equivalents.

What is claimed is:

1. A molded-together multi-unit pyrotechnic initiator assembly for incorporation into an inflator, said assembly comprising two or more pyrotechnic initiators each including an electrical igniter, a metal retainer, and a nonconductive molded body that is integrally and intimately bonded to and at least partly surrounding said electrical igniter and said retainer, wherein said molded body of each of said two or more initiators extends toward another of said two or more initiators so as to integrally bond together two or more initiators.

2. The assembly of claim 1, wherein each said initiator further comprises a connector toward which said retainer opens.

3. The assembly of claim 1, wherein each said initiator comprises an electrical igniter, and wherein said body is overmolded around said electrical igniter.

4. The assembly of claim 3, wherein said body is composed of nylon.

5. A method for making a molded-together multi-unit pyrotechnic initiator assembly for incorporation into an inflator, comprising the steps of:

providing two or more pyrotechnic initiators each including an electrical igniter and a metal retainer;

arranging said two or more pyrotechnic initiators so as to be adjacent; and molding a nonconductive body around at least part of said electrical igniter and said retainer of each of said two or more initiators, such that the resulting nonconductive body of each of said two or more initiators extends toward another of said two or more initiators so as to integrally join two or more initiators together.

6. The assembly of claim 1, wherein said two or more initiators comprise two initiators.

7. The assembly of claim 1, wherein said two or more initiators comprise at least three initiators.

8. The assembly of claim 1, wherein two or more of said metal retainers are formed from a unitary contiguous metal piece, so that two or more of said initiators are thus further integrally connected to each other by said unitary contiguous metal piece.

9. The assembly of claim 8, wherein said unitary contiguous metal piece is a stamped piece.

10. The assembly of claim 1, further comprising a base to which said molded bodies are integrally and intimately bonded.

11. The assembly of claim 10, wherein said bodies are overmolded around said electrical igniters.

12. The assembly of claim 11, further including an interlocking connection between said metal base and two or more of said retainers.

13. The method of claim 5, wherein two or more of said metal retainers are formed from a unitary contiguous metal piece, so that said step of molding results in two or more of said initiators being further integrally connected to each other by said unitary contiguous metal piece.

14. The method of claim 13, further comprising the step of forming said unitary contiguous metal piece by stamping.

15. The method of claim 5, further including the step of providing a base, and wherein said step of molding includes molding said bodies around part of said base so that said bodies are integrally and intimately bonded to said base.

16. The method of claim 15, further comprising the step of providing an interlocking connection between said base and two of said retainers.

17. The method of claim 16, wherein said step of molding includes overmolding said bodies around said electrical igniters.

18. The method of claim 5, wherein said two or more initiators comprise two initiators.

19. The method of claim 5, wherein said two or more initiators comprise at least three initiators.

20. The method of claim 14, wherein said step of molding includes overmolding said bodies around said electrical igniters.

* * * * *